US006594838B1

(12) United States Patent
Hollander et al.

(10) Patent No.: US 6,594,838 B1
(45) Date of Patent: Jul. 22, 2003

(54) PILLOW WITH TRANSPARENT WINDOW

(75) Inventors: Leo L. Hollander, Boca Raton, FL (US); Jeff Hollander, Boca Raton, FL (US)

(73) Assignee: Hollander Home Fashions Corp., Boca Raton, FL (US)

( * ) Notice: Subject to any disclaimer, the term of this patent is extended or adjusted under 35 U.S.C. 154(b) by 0 days.

(21) Appl. No.: 09/998,462

(22) Filed: Nov. 29, 2001

(51) Int. Cl.[7] ..... A61G 9/00
(52) U.S. Cl. ..... 5/636; 5/490; 5/737
(58) Field of Search ..... 5/636–645, 737, 5/738, 482, 490

(56) References Cited

U.S. PATENT DOCUMENTS

| | | | | | |
|---|---|---|---|---|---|
| 2,639,444 | A | * | 5/1953 | Monsabert | |
| 2,659,421 | A | * | 11/1953 | Wass et al. | 5/637 |
| 3,121,886 | A | * | 2/1964 | Seymour | |
| 3,298,044 | A | * | 1/1967 | Saltness et al. | 5/644 |
| 4,309,784 | A | | 1/1982 | Cohen | |
| 4,637,151 | A | * | 1/1987 | Love et al. | 5/653 |
| 4,669,587 | A | | 6/1987 | Zitt | |
| 4,737,998 | A | * | 4/1988 | Johnson, Sr. | 5/680 |
| 4,768,245 | A | | 9/1988 | Dutton | |
| 4,768,247 | A | | 9/1988 | Beier | |
| 4,959,880 | A | | 10/1990 | Tesch | |
| 5,007,470 | A | | 4/1991 | Freeman | |

FOREIGN PATENT DOCUMENTS

| | | | | |
|---|---|---|---|---|
| DE | 1023202 | * | 1/1958 | 5/636 |
| GB | 772025 | * | 4/1957 | 5/737 |

* cited by examiner

*Primary Examiner*—Alexander Grosz
(74) *Attorney, Agent, or Firm*—Lerner, David, Littenberg, Krumholz & Mentlik, LLP

(57) ABSTRACT

A pillow has a casing forming an interior space and a fill material contained within the interior space. The casing includes a transparent portion to provide visual access to the interior space of the casing. The transparent portion may comprise a supple, transparent material.

23 Claims, 2 Drawing Sheets

PILLOW WITH TRANSPARENT WINDOW

FIELD OF THE INVENTION

The present invention relates to pillows, and more particularly to pillows having a casing with a transparent portion.

BACKGROUND OF THE INVENTION

Pillows are available in a variety of different styles designed to accommodate the widely varying preferences of the purchasing public. This is particularly evident in the fill materials used to provide the pillows with their loft and cushioning. Typically, pillows are filled with either natural fill materials, such as feathers or down, or synthetic fill materials, such as polyester fibers or foam materials. However, within these broad classes of materials, there are a variety of products which vary widely in terms of their quality and comfort. Thus, for example, within the class of materials broadly referred to as "white goose feathers" are feathers with different lengths ranging from about 1.5 inches to about 4 inches. The shorter feathers generally have a larger percentage of plume with relatively short quills, while the longer feathers generally have longer, more prominent quills and a lower percentage of plume. As a result, although two pillows may be made with white goose feathers, the pillow made with longer feathers will have a greater amount of quills, and will be less comfortable than the pillow made with short feathers.

The same wide range of materials can be found within the class of materials referred to as synthetic fill materials. For example, polyester fibers are available in a wide range of qualities, from crimped straight fibers at the low end to ball fibers having a down-like quality at the high end, with fibers of intermediate quality between these extremes, including microdenier fibers, spiral fibers and continuous fibers.

When pillows are manufactured, after the fill material has been placed in the casing through an open side, the open side of the casing is typically sewn or otherwise permanently closed to prevent the fill material from escaping. As a result, it is impossible for the consumer to see precisely which fill material is in the pillow being purchased. Although federal law requires a label to be attached to the pillow to identify the type of fill material contained therein, i.e., feathers, polyester fibers, etc., that information says nothing at all about the quality of the material within the pillow. In other words, a pillow having a label identifying the fill material as polyester fibers, while complying with applicable federal law, does not inform the purchaser whether the polyester fiber is of a high or low quality.

Furthermore, after extended use of a pillow, the fill material may become compressed and lose resiliency or loft. The consumer may notice that the fill material is compacted, but does not benefit from a visual inspection of the fill material because the fill material cannot be viewed to determine its condition as the pillow is used.

Pillowcases having pockets for displaying or carrying various articles, such as books, memorabilia, or the like, are known. In addition, a pillow having a pillow casing containing the fill material and an exterior transparent bag of flexible plastic material covering the pillow casing is also known. However, such pillows do not allow the consumer to view the fill materials within the pillow. The consumer cannot verify the quality of the fill material before purchase, or verify the condition of the fill material after the pillow has been used for some period of time.

There therefore exists a need for a pillow having a casing which will securely retain a fill material, yet which will enable consumers to readily identify the quality and condition of the fill material therein.

SUMMARY OF THE INVENTION

The present invention addresses these needs.

In one aspect of the present invention, a pillow has a casing with an interior space and a fill material contained in the interior space. The casing includes a nontransparent portion and a transparent portion. The transparent portion provides visual access to the interior space of the casing and preferably comprises a supple, transparent material and may comprise a polymeric material and may comprise a supple, transparent vinyl material.

In certain preferred embodiments, the transparent portion comprises a transparent panel of material. The panel itself preferably comprises a supple, transparent material and may comprise a polymeric material. For example, the transparent panel may comprise a panel of supple, transparent vinyl material, such as a supple, transparent polyvinyl chloride ("PVC"). The transparent panel may extend between longitudinal edges of the casing adjacent one end of the casing.

The pillow may comprise, for example, at least one panel of casing material for enclosing the interior space. The at least one panel may include a transparent portion or a transparent panel for providing visual access to the interior space.

In certain preferred embodiments, the at least one panel comprises a first panel and a second panel arranged in an opposed relationship. The at least one panel further comprises a plurality of side panels attaching edges of the first panel to corresponding edges of the second panel. One of the panels preferably comprises a transparent panel. For example, the plurality of side panels may include at least one transparent panel.

In certain preferred embodiments, the pillow includes at least one panel having at least one nontransparent panel and at least one transparent panel. The nontransparent panel has an edge connected to an edge of the transparent panel. For example, the pillow may have a first panel and a second panel. The first panel has a first edge and a second edge, whereas the second panel has an alpha edge and a beta edge. The casing is formed by connecting the first panel, second panel and transparent panel. The first edge of the first panel may be connected to the alpha edge of the second panel and at least one transparent panel may be connected to the first panel and the second panel to form the casing of the pillow. In certain preferred embodiments, the transparent panel is connected between the second edge and the beta edge of the other panels. In other preferred embodiments, the transparent panel may be connected to the first panel at a location spaced from the second edge of the first panel.

In a preferred embodiment, the at least one panel includes first and second edges and a pair of longitudinal edges extending between the first and second edges. The transparent panel extends between the longitudinal edges adjacent one of the first and second edges.

In another aspect of the present invention, the pillow includes a casing having an interior space and an openable end, with a fill material contained within the interior space. A transparent panel is joined to the casing adjacent the openable end to enclose the interior space while providing visual access thereto. Preferably, the casing comprises a pair of panels joined together. A releasable fastener may be included for opening and closing the openable end.

The transparent panel is preferably formed from a supple, transparent polymer material.

Desirably, the pillow comprises a pair of panels and one panel of the pair of panels includes a second edge at the openable end of the casing and the other panel of the pair of panels has a beta edge at the openable end of the casing. The transparent panel includes a pair of opposed edges. One of the edges of the transparent panel is joined to the second edge at a first spaced distance from the second edge. Another of the edges of the transparent panel is joined to the beta edge at a second spaced distance from the beta edge. In certain preferred embodiments, the second spaced distance is greater than the first spaced distance.

BRIEF DESCRIPTION OF THE DRAWINGS

These and other features, aspects, and advantages of the present invention will become better understood with regard to the following detailed description, appended claims, and accompanying drawings in which:

DETAILED DESCRIPTION OF THE PREFERRED EMBODIMENTS

Figure 1:
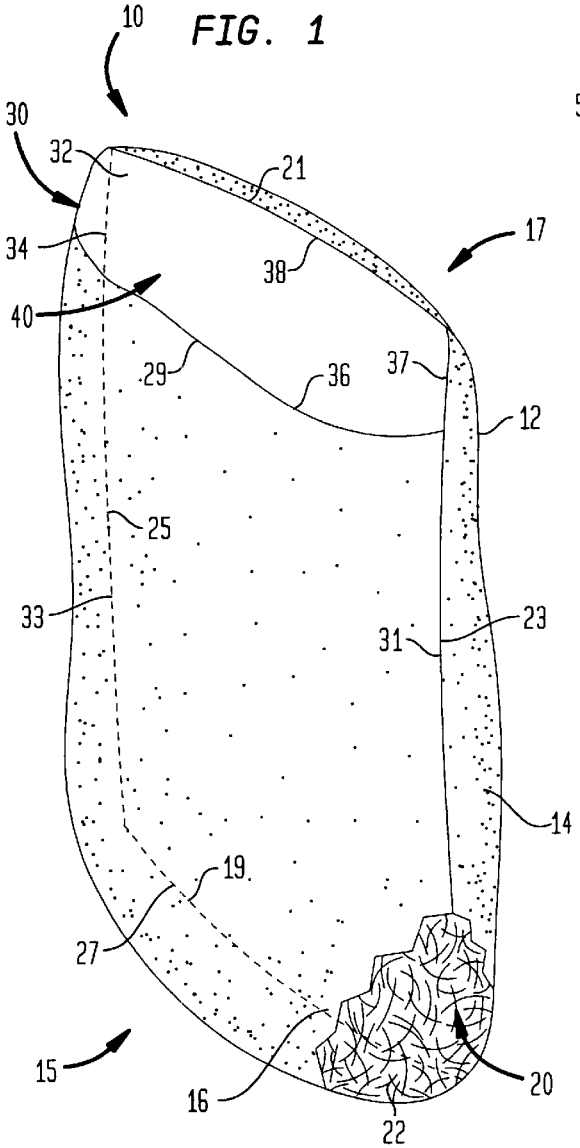
FIG. 1 is a perspective view of a pillow in accordance with one embodiment of the present invention, partially broken away to show the interior thereof.

Referring to FIG. 1, there is illustrated one preferred embodiment of a pillow 10 in accordance with the present invention. Pillow 10 typically has a conventional, essentially rectangular shape in plan, defined by an outer cover or casing 12. The casing 12 shown in FIG. 1 has a first end 15 and a second end 17, each of which are permanently closed. The casing 12 encloses an interior cavity 20.

The casing 12 is formed from panels of casing material. The casing has a first panel 14 of casing material and a second panel 16 of casing material. The first panel 14 has a first edge 19 at the first end 15 of the casing 12, a second edge 21 at the second end 17 of the casing 12, and longitudinal edges 23 and 25 extending between the first edge 19 and second edge 21. The second panel 16 has an alpha edge 27 at the first end 15 of the casing 12, a beta edge 29 at the second end 17 of the casing 12, and longitudinal edges 31 and 33 extending between the alpha edge 27 and the beta edge 29.

The first panel 14 and second panel 16 form a nontransparent portion 35 of the casing 12. The casing 12 also has a transparent portion 30. As used herein, transparent means transmissive of enough light so that the consumer can view the fill of the pillow fairly clearly and determine the quality thereof. In the embodiment shown in FIG. 1, the nontransparent portion is comprised of nontransparent panels 14 and 16. The transparent portion 30 comprises a transparent panel 32 formed from a transparent material. The transparent panel 32, first panel 14, and second panel 16 are joined to one another to form a casing having a window 40 for viewing the interior cavity 20 of the pillow 10. Desirably, transparent panel 32 is formed adjacent an end of the casing 12, such as second end 17 as illustrated in FIG. 1.

Transparent panel 32 of FIG. 1 has a generally rectangular shape with four edges that are joined to edges of the first panel 14 and second panel 16. For example, the transparent panel 32 shown in FIG. 1 has a W edge 38, an X edge 34, a Y edge 36 and a Z edge 37. In an embodiment in which the transparent panel 32 is rectangular, the X edge 34 and the Z edge 37 are shorter than the W edge 38 and the Y edge 36. The first panel 14, second panel 16, and transparent panel 32 are joined together along their peripheral edges to define the interior cavity 20 therebetween. Thus, in the embodiment shown in FIG. 1, the first edge 19 is joined to the alpha edge 27, the second edge 21 is joined to the W edge 38, the beta edge 29 is joined to the Y edge 36, longitudinal edge 23 is joined to longitudinal edge 31, and longitudinal edge 25 is joined to longitudinal edge 33. The X edge 34 and Z edge 37 are also joined to longitudinal edges of the first panel 14.

As discussed further hereinbelow, the interior cavity 20 contains a fill material 22 which provides cushioning for pillow 10. Panels 14 and 16 may be formed from any soft, flexible material capable of retaining fill material 22 within cavity 20. Desirably, panels 14 and 16 comprise a translucent or opaque material, formed from a tightly woven textile fabric which will prevent or minimize any loss of the fill material through the casing 12. For example, the fabric may comprise a cotton or cotton-blend. The panels may also comprise a polymeric material, such as vinyl material including polyvinyl chloride ("PVC"). The panels may also comprise matted material, such as felt. The peripheral edges of panels 14, 16 and 32 may be joined by any conventional means capable of preventing the fill material 22 from escaping from interior cavity 20. Preferably, panels 14, 16 and 32 are sewn together along their peripheral edges to provide outer cover 12 with superior structural integrity. In certain embodiments, the peripheral edges are joined utilizing adhesive.

The fill material 22 in cavity 20 may consist of any materials commonly used to stuff pillows and cushions. Such materials may include natural fill materials, such as feathers, down and combinations thereof, or synthetic fill materials, such as polymer fibers of various types, foam materials, including foam rubber and urethane foams, and combinations of the foregoing. One preferred natural fill material is a combination of about 95% by weight feathers and 5% by weight down. Polyester fibers are a preferred synthetic fill material. Preferably, between about 12 ounces and about 60 ounces of fill material 22 are used to fill cavity 20, depending on the rectangular size of the pillow and the fill material used therein. Where fill materials consisting of about 95% by weight feathers and about 5% by weight down are used, a standard size pillow typically is stuffed with about 28 ounces of fill material. Where fill materials consisting of polymer fibers are used, about 18 ounces of fill material typically is used to stuff a standard size pillow. More or less fill material may be used. It will be appreciated that greater amounts of fill material generally will be used for stuffing queen and king size pillows.

Although the pillow 10 shown in FIG. 1 has a standard shape and may comprise a standard, queen or king size pillow, the pillow may have any shape and size.

Transparent panel 32 may be formed from any transparent material which permits the consumer to readily see the interior cavity 20 within the casing 12, while at the same time preventing the fill material from escaping from the casing 12. So that the fill material 22 in cavity 20 may be viewed by a consumer, transparent panel 32 forms part of the casing 12 of the pillow 10. The transparent panel 32 may be formed from any transparent material that can be attached to the other panel or panels of the casing 12. The transparent panel 32 may comprise a sheet of a polymeric material. The transparent panel 32 may be formed from a sheet of a transparent polymer, such as polyethylene or polyvinyl chloride, which is sewn, glued, heat-sealed or otherwise joined along its peripheral edges to the other panels of the casing 12.

A drawback of certain sheets of polymeric materials is that they crease and crinkle when a consumer lays upon the pillow. In embodiments in which such sheets of polymeric materials are used, the transparent panel 32 is preferably located at an end of the pillow 10 so that the consumer will generally lay upon a central portion of the pillow and avoid the transparent panel 32.

Preferably, the transparent panel 32 comprises a supple, transparent material. Certain vinyl materials, such as certain polyvinyl chloride ("PVC") materials may be used. A preferred material is called rubberized PVC, which is available in a range of hardness/softness. A preferred rubberized PVC is available from Golden Noon Industry, Ltd., Item No. ACA64/K001. The supple transparent material is preferably supple enough so that the material does not crease, crinkle or otherwise interfere with the comfort of the consumer.

The transparent panel may have any shape, such as square, round, etc., and may be disposed anywhere on the pillow, such as the middle where the consumer generally lays upon the pillow.

Although FIG. 1 illustrates the transparent panel 32 as extending across the entire width of pillow 10, this need not be the case and panel 32 may consist of a small patch of a transparent material in a rectangular, round or any other shape joined as a window to panel 16.

Figure 2:
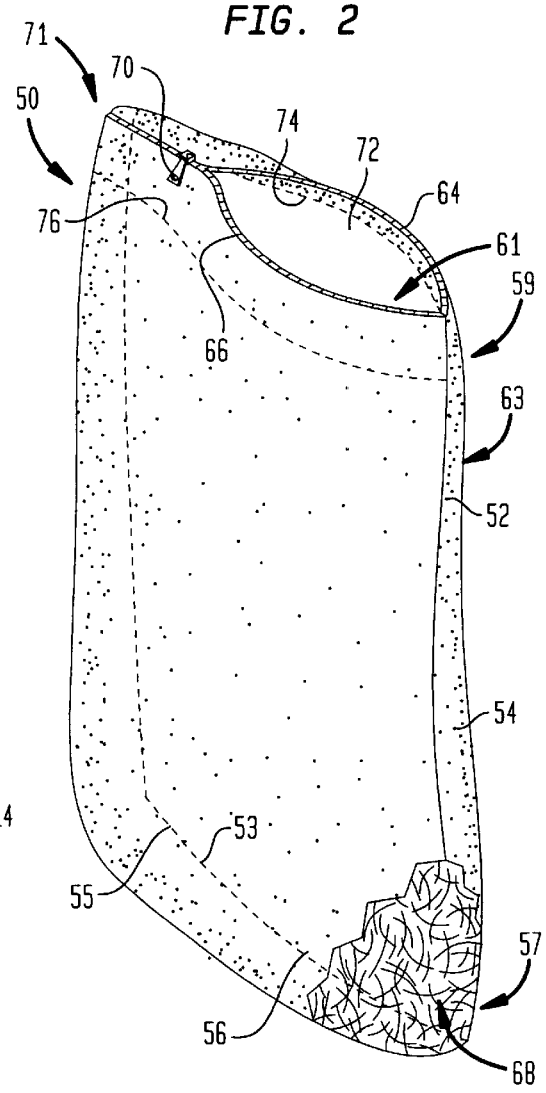
FIG. 2 is a perspective view of a pillow in accordance with another embodiment of the present invention, partially broken away to show the interior thereof and with the fastener at one end partially opened to reveal the transparent panel.

Another preferred embodiment of a pillow 50 in accordance with the present invention is illustrated FIG. 2. Pillow 50 according to this embodiment may have an outer cover or casing 52 formed from a first panel 54 and a second panel 56 that may have the same general shape and construction of the panels 14 and 16 discussed above. The casing 52 has a nontransparent portion 63 and a transparent portion 61 adjacent second end 59 of the casing 52. The first panel 54 and second panel 56 are joined together, as by sewing, along their peripheral edges to define an interior cavity 68 therebetween. The casing 52 has a first end 57, at which a first edge 53 of the first panel 54 is joined to an alpha edge 55 of the second panel 56. A releasable fastener 70, such as a zipper, is provided at the second end 59 of the casing 52. The releasable fastener is disposed between the second edge 64 of the first panel 54 and beta edge 66 of the second panel 56 to form an openable end 71 at the second end 59 of the casing 52. The releasable fastener 70 provides access to the transparent portion 61 of the pillow, which, in this embodiment, comprises a transparent panel 72, connected between the first panel 54 and second panel 56. In place of the zipper, edges 64 and 66 may include any other releasable fastener, including hook and loop fasteners, snaps, buttons and the like.

The pillow 50 has fill material 51 and may be filled with the same fill material as described above in connection with pillow 10. In order to prevent fill material 51 from escaping from cavity 68, while at the same time providing visual access to the fill material within cavity 68, the pillow 50 includes a transparent panel 72 sewn, glued, heat-sealed or otherwise joined between panels 54 and 56. Thus, three panels of material enclose the fill material 51.

In the embodiment shown in FIG. 2, the transparent panel 72 is joined to panels 54 and 56 so that a first edge 74 of transparent panel 72 is relatively close to the second edge 64 and the second edge 76 of transparent panel 72 is relatively distant to beta edge 66, as illustrated. However, the second edge 76 of the transparent panel 72 may be relatively close to the beta edge 66 and the first edge 74 of transparent panel 72 may be relatively distant to second edge 64. Attachment in this manner will orient panel 72 so that it is generally not perpendicular to panels 54 and 56. In embodiments in which the transparent panel 72 is a material that creases and crinkles as discussed above, the embodiment shown in FIG. 2 minimizes any structural rigidity that the panel adds to the pillow 50 and may avoid the creasing and crinkling of the transparent panel 72 upon use of the pillow. In other preferred embodiments, the transparent panel 72 comprises a supple transparent material. The transparent portion 61 may comprise any transparent material, as discussed above.

Outwardly, pillow 50 has the appearance of a conventional pillow. However, simply by opening the releasable fastener 70, a consumer can see the fill material within the interior cavity of the casing 52 without the risk of the fill material escaping therefrom. Once the consumer has identified the particular type of fill material in the pillow, the releasable fastener 70 can be closed to return the pillow to its conventional appearance.

Figure 3:
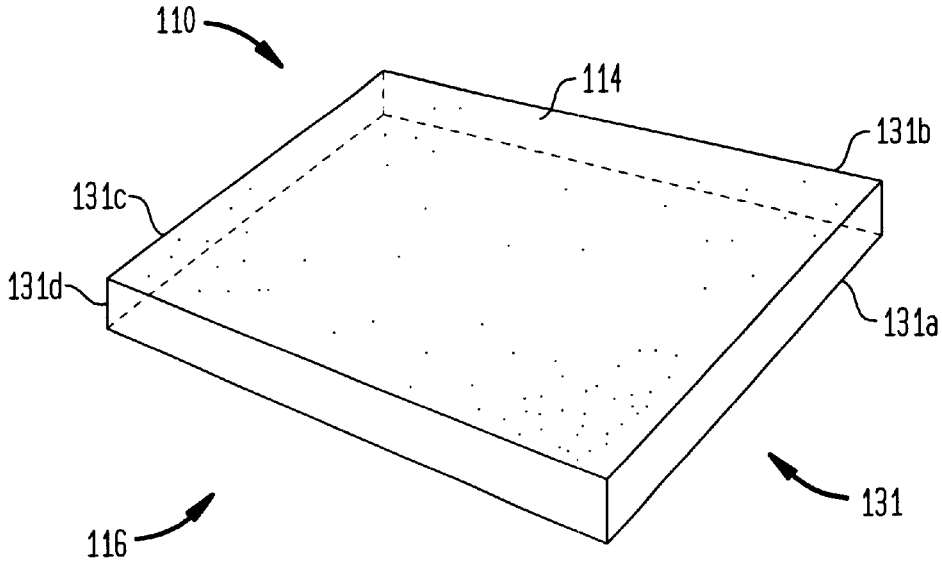
FIG. 3 is a top-right perspective view of a pillow in accordance with a further embodiment of the present invention.

In other preferred embodiments, the pillow has more than three panels. In the embodiment shown in FIG. 3, the pillow 110 has the shape of a rectangular box. The pillow 110 has a first non-transparent panel 114, a second non-transparent panel 116 arranged in an opposed relationship. The four side panels 131 are adjoined to the edges of the non-transparent panel 114 and second non-transparent panel 116. The four side panels 131 connect each of the edges of the first non-transparent panel to a corresponding edge of the second non-transparent panel so as to enclose an interior cavity 120.

At least one of the four side panels 131 comprises a transparent panel for allowing visual access to the interior cavity 120 of the pillow. The at least one transparent panel forms a transparent portion for the pillow 110. In certain embodiments, a first side panel 131*a* comprises a transparent panel and a second side panel 131*b*, third side panel 131*c*, and fourth side panel 131*d* comprise non-transparent panels. In other embodiments, two opposed side panels, such as first side panel 131*a* and third side panel 131*c* comprise transparent panels, whereas second side panel 131*b* and fourth side panel 131*d* comprise non-transparent panels. In further embodiments, two adjacent side panels comprise transparent panels and two other adjacent side panels comprise non-transparent panels. In other embodiments, the pillow 110 includes three or four transparent panels. The pillow 110 is constructed as discussed above in connection with FIGS. 1 and 2. Preferably, the transparent panel or transparent panels comprise a supple transparent material. For example, the transparent panels may comprise a supple vinyl material, such as a supple PVC.

Figure 4:
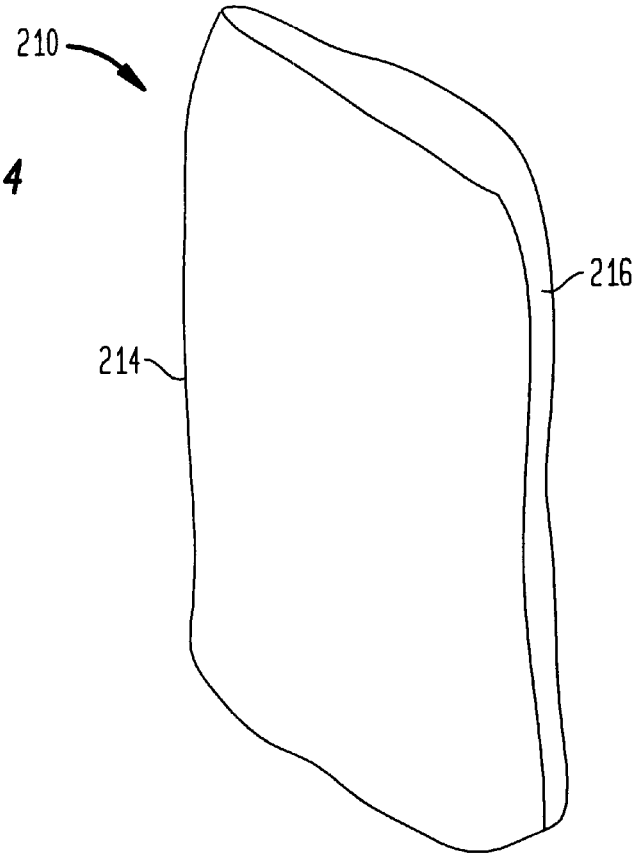
FIG. 4 is a perspective view of a pillow in accordance with yet another embodiment of the present invention.

The pillow, in embodiments according to the invention, may comprise any number of panels for enclosing the fill material for the pillow. In certain embodiments, the pillow comprises at least one transparent panel forming an interior cavity, in which the entire pillow comprises a transparent portion. In the embodiment of FIG. 4, the pillow 210 comprises a first panel 214 and a second panel 216 that are transparent. Edges of the first panel 214 are attached to edges of the second panel 216 in the manner discussed above in connection with FIGS. 1 and 2. As each of the first panel 214 and second panel 216 comprise transparent panels, the entire pillow 210 comprises a transparent portion. The entire pillow 210 allows visual access to the interior cavity of the pillow. A non-transparent cover, comprising two non-transparent panels attached to one another and having a releasable fastener at one end, may accompany the pillow 210. The non-transparent cover allows the consumer to cover the pillow so that the filling in the interior cavity is not visible from the outside of the pillow 210, if desired. In another embodiment, the entire pillow shown in FIG. 3 may comprise a transparent portion. In such an embodiment, each of the panels comprising the pillow are transparent.

Although the invention herein has been described with reference to particular embodiments, it is to be understood that these embodiments are merely illustrative of the principles and applications of the present invention. For example, either or both of the ends of the casing may be openable ends and may have releasable fasteners. In addition, the casing may be formed by a single panel of at least partially translucent or opaque material, or comprised of more than two panels of translucent or opaque material. More than one transparent panel may also be provided. Although transparent panels are shown in FIGS. 1 and 2, the transparent portion of the casing may comprise a transparent portion of a panel of the casing which is otherwise translucent or opaque. The pillow, although shown in FIGS. 1 and 2 as having a rectangular shape in plan, may have various shapes. For example, the pillow may be triangular, hexagonal, or even heart-shaped in plan, or in elevation.

It is therefore to be understood that numerous modifications may be made to the illustrative embodiments and that other arrangements may be devised without departing from the spirit and scope of the present invention as set forth in the appended claims.

We claim:

1. A pillow, comprising:

a casing having an interior space, said casing including a transparent portion for providing visual access to said interior space of said casing, and a nontransparent portion; and a fill material positioned within said interior space of said casing, whereby said fill material is visible through said transparent portion.

2. The pillow as claimed in claim 1, wherein said casing has at least one panel of casing material for enclosing said interior space.

3. The pillow as claimed in claim 2, wherein said at least one panel includes at least one transparent portion for providing visual access to said interior space.

4. The pillow as claimed in claim 3, wherein said at least one panel comprises a first panel and a second panel arranged in an opposed relationship.

5. The pillow as claimed in claim 4, wherein said at least one panel further comprises a plurality of side panels attaching edges of said first panel to corresponding edges of said second panel.

6. The pillow as claimed in claim 5, wherein said plurality of side panels includes at least one transparent panel.

7. The pillow as claimed in claim 3, wherein said at least one panel includes at least one transparent panel for providing visual access to said interior space.

8. The pillow as claimed in claim 7, wherein said at least one panel includes at least one nontransparent panel having an edge and said at least one transparent panel has an edge for being connected to said edge of said at least one nontransparent panel.

9. The pillow as claimed in claim 7, wherein said at least one panel comprises a first panel and a second panel, said first panel having a first edge and a second edge, said second panel having an alpha edge and a beta edge, said first edge being connected to said alpha edge, and said at least one transparent panel being connected to said first panel and said second panel.

10. The pillow as claimed in claim 9, wherein said at least one transparent panel is connected between said second edge and said beta edge.

11. The pillow as claimed in claim 9, wherein said transparent panel is connected to said first panel at a location spaced from said second edge.

12. The pillow as claimed in claim 7, wherein said transparent panel comprises a supple, transparent material.

13. The pillow as claimed in claim 12, wherein said at least one panel includes first and second edges and a pair of longitudinal edges extending between said first and second edges, said transparent panel extending between said longitudinal edges adjacent one of said first and second edges.

14. The pillow as claimed in claim 7, wherein said transparent panel comprises a polymeric material.

15. The pillow as claimed in claim 14, wherein said transparent panel comprises a supple, transparent vinyl material.

16. The pillow as claimed in claim 1, wherein said transparent portion comprises a supple, transparent material.

17. The pillow as claimed in claim 1, wherein said transparent portion comprises a polymeric material.

18. The pillow as claimed in claim 13, wherein said transparent portion comprises a supple, transparent vinyl material.

19. A pillow, comprising:

a casing having an interior space and an openable end;

a fill material positioned within said interior space of said casing; and a static transparent panel secured to said casing within said openable end for enclosing said interior space while providing immediate visual access to said fill material.

20. The pillow of claim 19, wherein said casing comprises a pair of panels joined together.

21. The pillow of claim 20, further comprising a releasable fastener for opening and closing said openable end.

22. The pillow as claimed in claim 20, wherein one of said pair of panels includes a second edge at said openable end of said casing and the other of said pair of panels has a beta edge at said openable end, said transparent panel including a pair of opposed edges, one of said opposed edges of said transparent panel being joined to said second edge at a first spaced distance from the second edge thereof, the other of said opposed edges of said transparent panel being joined to said beta edge at a second spaced distance from the beta edge, said second spaced distance being greater than said first spaced distance.

23. The pillow as claimed in claim 19, wherein said transparent panel is formed from a supple, transparent polymer material.

* * * * *

UNITED STATES PATENT AND TRADEMARK OFFICE

CERTIFICATE OF CORRECTION

PATENT NO. : 6,594,838 B1 
DATED : July 22, 2003
INVENTOR(S) : Leo L. Hollander and Jeff Hollander It is certified that error appears in the above-identified patent and that said Letters Patent is hereby corrected as shown below:

Column 8,
Line 33, "13" should read -- 17 --.

Signed and Sealed this

Second Day of December, 2003

JAMES E. ROGAN
*Director of the United States Patent and Trademark Office*